US008123425B2

(12) United States Patent
Agrawal

(10) Patent No.: US 8,123,425 B2
(45) Date of Patent: Feb. 28, 2012

(54) REFILL ADAPTOR

(76) Inventor: Lalit Agrawal, Kolkata (IN)

( * ) Notice: Subject to any disclaimer, the term of this patent is extended or adjusted under 35 U.S.C. 154(b) by 413 days.

(21) Appl. No.: 12/520,100

(22) PCT Filed: Sep. 8, 2008

(86) PCT No.: PCT/IN2008/000575

§ 371 (c)(1),
(2), (4) Date: Jun. 19, 2009

(87) PCT Pub. No.: WO2009/133568

PCT Pub. Date: Nov. 5, 2009

(65) Prior Publication Data

US 2010/0278581 A1 Nov. 4, 2010

(30) Foreign Application Priority Data

May 2, 2008 (IN) ..... 804/KOL/2008

(51) Int. Cl.
*B43K 7/10* (2006.01)

(52) U.S. Cl. ..... 401/216

(58) Field of Classification Search ..... 401/209, 401/211, 216, 141
See application file for complete search history.

(56) References Cited

U.S. PATENT DOCUMENTS 6,454,481 B1 * 9/2002 Izumi ..... 401/141

FOREIGN PATENT DOCUMENTS

| | | |
|---|---|---|
| EP | 1795368 | 6/2007 |
| GB | 688893 | 3/1953 |
| JP | 9-2487991 | 9/1997 |

OTHER PUBLICATIONS

International Search Report and Written Opinion for PCT/IN2008/000575.

* cited by examiner

*Primary Examiner* — Tuan Nguyen
(74) *Attorney, Agent, or Firm* — Garcia-Zamor IP Law; Ruy M. Garcia-Zamor

(57) ABSTRACT

A refill adaptor for use in ball point pens essentially comprising a main body (10), comprising of a front part (15) and a rear shank portion (20). The front part (15) and said rear shank portion (20) are rigidly coupled together with a ring member (25); and said main body (10) having a capillary tube (40) throughout its length. The said front part (15) is provided with a front housing (35) for holding the refill tip (55) provided with a ball point (65) for smooth writing, said capillary tube being provided with a ink channel, the internal diameter of which is selected to be about 0.8 mm and the outer diameter of said capillary being selected as about 1.8 mm for easy flow of ink from ink reservoir to said ball point (65).

8 Claims, 1 Drawing Sheet

REFILL ADAPTOR

BACKGROUND OF THE INVENTION

The invention relates to a refill adaptor for a ball point pen using mini tips for making ball point pen refills. More particularly, the invention relates to a refill adaptor for ball point pens of varying length to enable the use of mini tips made from about 1.50-1.65 mm wire diameter instead of about 2.00-2.30 mm wire diameter.

PRIOR ART

The commonly used types of ball point refills which are available in the market can be broadly classified in two categories— a) Refills using BIC (BIC is a trade name of BIC Corporation, France) style ball point pen tips, adaptor, refill tube and ink. Ordinarily the shank diameter of such adaptor is usually about 4.00 mm.

b) Refill using ball point pen tips like Pilot, D6, D4, Ohto, Zebra etc., refill tube or cartridge of about 2.70 mm-3.00 mm. outside diameter and ink. In this refills there is no possibility to use mini-tips at present made from wire of about 1.50 mm-1.65 mm diameter.

In the conventional ball point pen, the tips are made of wires of brass or an alloy of nickel and silver. Further the average diameter of such tips varies between about 2.00 mm and 2.30 mm. Thus the conventional ball point pen suffers from inherent disadvantages, namely it requires extra or additional materials in making the tips with bigger diameter wire than what is actually required in the mini tips which is about 1.50-1.65 mm in diameter. Further no adaptor is available in the market, which can accommodate tips made of lesser diameter wire to make ordinary refills with the refill tube or cartridge having outside diameter of about 2.70-3.00 mm. This enhances the cost of making known types of ball point pen refills. Several attempts have been made to overcome these difficulties but without success.

In known type of ball point pen using BIC style refills, refills are made using adaptor, BIC style ball point pen tips, refill tube and ink. However, there is no adaptor to accommodate tips made from wire in the range of about 1.50 mm to 1.65 mm in diameter available in the market. This wire of lesser diameter not only make the ball point pen much more economical compared to the conventional ball point pens due to less amount of material required, additionally such lesser diameter would allow the pen to more attractive to the customer.

It is known among persons skilled in the art that the main difference between ordinary and BIC type tipped refills are as follows:

a. The tips used in BIC type is the BIC tip while the ordinary refills uses Pilot, D6, D4, Ohto, Zebra or such other type of tips usually made from about 2.00 to 2.30 mm wire, the refill tube or cartridge outer diameter being about 2.70 to 3.30 mm and tip is directly mounted or inserted in refill tube or cartridge containing ink.
b. There is no adaptor in the ordinary type of refills enabling it to use about 1.50-1.65 mm wire mini tips.
c. The BIC tube refills are front loading while the ordinary refills are rear loading.

It has therefore been the endeavor of the Applicant to mitigate these drawbacks of the conventional ball point pens and to make an ordinary ball point pen refill using an adaptor for refill which enables usage of ball pen tips of no less technical requirement but of less material and thereby reducing the cost considerably.

OBJECT OF THE PRESENT INVENTION

It is an object of the invention to provide an adaptor which enables use of ball point pen tips made from about 1.50-1.65 mm diameter wire of brass or alloy of nickel and silver to make a refill for ball point pen using refill tube or cartridge of about 2.70-3.00 mm outside diameter.

It is also an object of the invention of the invention to provide for an adapter which results in reduction in the cost of the refill without any alteration in the existing design of ball point pens or the ink quantity necessary for adequate writing.

DESCRIPTION OF THE INVENTION

Accordingly, there is provided a refill adaptor for making ball point pens refills comprising a main body, comprising of a front portion and a rear shank portion, said front portion and said rear shank portion are rigidly coupled together with a ring member, said main body having a capillary hole throughout its length, said front portion being provided with a front housing for holding the mini ball point pen tip provided with a ball for smooth writing, the capillary provides a ink channel, the internal diameter of which is selected to about 0.8 mm and the outer diameter of said capillary being selected to about 1.8 mm for free flow of ink from ink reservoir or refill tube or cartridge made from about 2.70-3.00 mm tube to the ball point tip.

A refill adaptor according to the invention has outside diameter of the front portion of about 2.25-2.30 mm and inner hole diameter of the front portion of about 1.55 mm.

A refill adaptor wherein the ball point pen tip of the refill is housed within the housing of the front part so as to hold the ball point pen tip along the longitudinal axis of the refill.

The present invention thus, provides a new ball point pen refill using an adaptor which is much more economical. Further such adaptor also saves the cost of the material of the tip.

With the newly designed adaptor, one can use about 1.50-1.65 mm diameter wire ball point pen tips in the ordinary refill where the outside diameter of the refill tube is about 2.70-3.00 mm, which was not possible without the present invention.

The advantage of the new adaptor is to use about 1.50-1.65 mm diameter wires ball point pen tips in the ordinary refills having outside diameter of the refill tube as about 2.70-3.00 mm, thereby cutting cost as compared to about 2.00-2.30 mm diameter ball point pen tips.

BRIEF DESCRIPTION OF THE DRAWINGS

The refill adaptor of the present invention is described herein below with reference to accompanying drawings, wherein.

Figure 1:
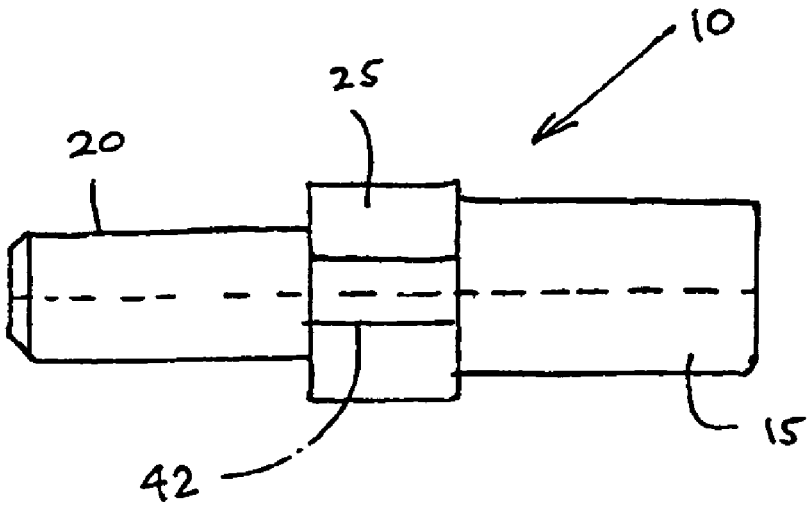
FIG. 1 shows a side plan of the refill adaptor of the present invention.

With reference to accompanying drawings, the refill adaptor essentially comprises a main body (10) essentially comprising two parts, a front part (15) and a rear shank portion (20). The said front part (15) and rear shank portion (20) are rigidly joined together with a ring member (25) having an aperture (42).

Figure 2:
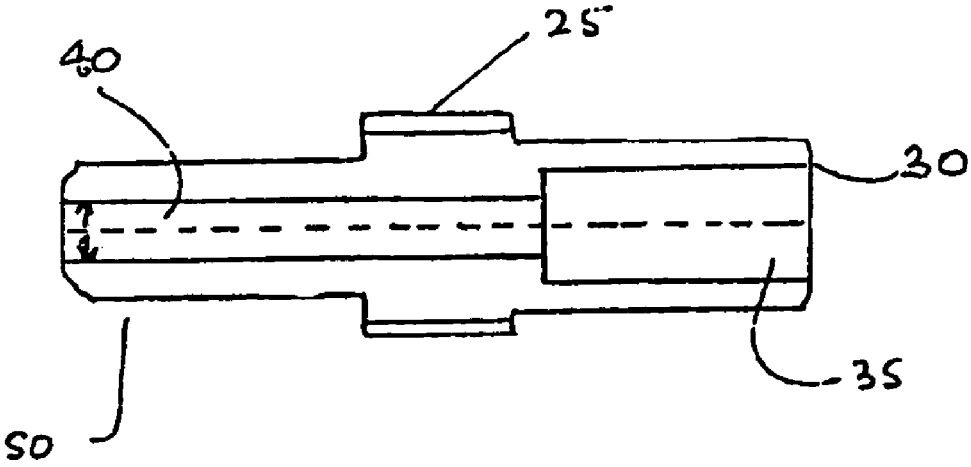
FIG. 2 shows a section of the refill adaptor of the present invention.
Figure 3:
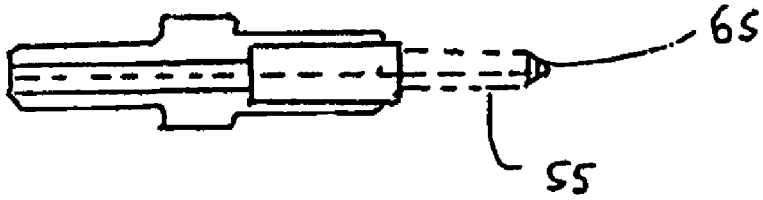
FIG. 3 shows the refill adaptor of the present invention fitted with refill tube and ball point pen tip.

FIG. 2 shows that the refill adaptor of the present invention is provided with a front face (30) having a hole (35), which continues from the front face of the refill adaptor and extends till the end of the rear shank (20). The internal diameter of the hole (35) is wider in the front (1.50 mm-1.55 mm) and narrower in the rear portion. The diameter of the shank (20) is about 0.8 mm while the outer diameter of the shank (20) is around 1.8 mm. The front part (15) of the refill adaptor holds the tip of the refill (55) having a ball which is provided with a uniform capillary tube (40) for holding ink as shown in FIG. 3. The other end of said capillary is kept open for the uniform flow of ink through the said ink channel (40) to the ball point (65).

It will be apparent from the Drawings that the adopter is used in relation to ordinary type of refill of ball-point pens having the refill fitting hole diameter of about 2.30-2.40 mm for the fitment of refill in the ball point pen.

The invention has been described with reference to various specific and preferred embodiments and techniques which are provided merely to be exemplary of the invention and do not limit the scope of the invention. It should be understood that many variations and modifications will be apparent to those skilled in the art while remaining within the spirit and scope of the invention and all such modifications and equivalents are intended to be included within the scope of the present invention.

What is claimed is:

1. A refill adaptor for use in ball point pens refills comprising a main body (10), comprising of a front part (15) and a rear shank portion (20), said front part (15) and said rear shank portion (20) being rigidly coupled together with a ring member (25); said main body (10) having a capillary tube (40) throughout its length, said front part (15) being provided with a front housing (35) for holding a refill tip (55) provided with a ball point (65) for smooth writing, said capillary tube being provided with a ink channel, the internal diameter of said in channel is selected to be about 0.8 mm and the outer diameter of said capillary tube is about 1.8 mm for easy flow of ink from ink reservoir to said ball point (65).

2. The refill adaptor as claimed in claim 1 wherein the said front part (15) of the refill adaptor is provided with a front face (30) housing (35) for holding the ball point pen tip.

3. The refill adaptor as claimed in claim 1 wherein said ring member (25) integrally connects said front part (15) and said rear shank portion (20) of said refill adaptor having an aperture (42) for the free flow of ink through said capillary ink channel (40).

4. The refill adaptor as claimed in claim 1 wherein said refill tip (55) is push fitted to the capillary ink channel (40) so that the entire length of the capillary ink channel is telescopically fitted to said refill adaptor without any obstruction.

5. The refill adaptor as claimed in claim 2 wherein said ring member (25) integrally connects said front part (15) and said rear shank portion (20) of said refill adaptor having an aperture (42) for the free flow of ink through said capillary ink channel (40).

6. The refill adaptor as claimed in claim 2 wherein said refill tip (55) is push fitted to the capillary ink channel (40) so that the entire length of the capillary ink channel is telescopically fitted to said refill adaptor without any obstruction.

7. The refill adaptor as claimed in claim 3 wherein said refill tip (55) is push fitted to the capillary ink channel (40) so that the entire length of the capillary ink channel is telescopically fitted to said refill adaptor without any obstruction.

8. The refill adaptor as claimed in claim 5 wherein said refill tip (55) is push fitted to the capillary ink channel (40) so that the entire length of the capillary ink channel is telescopically fitted to said refill adaptor without any obstruction.

* * * * *